US007530404B2

(12) United States Patent
Lenz, Jr.

(10) Patent No.: US 7,530,404 B2
(45) Date of Patent: May 12, 2009

(54) COMPRESSED FLUID SYSTEM AND RELATED METHOD

(75) Inventor: Kenneth C. Lenz, Jr., Hudsonville, MI (US)

(73) Assignee: HME, Inc., Wyoming, MI (US)

( * ) Notice: Subject to any disclaimer, the term of this patent is extended or adjusted under 35 U.S.C. 154(b) by 322 days.

(21) Appl. No.: 11/458,796

(22) Filed: Jul. 20, 2006

(65) Prior Publication Data

US 2008/0017391 A1 Jan. 24, 2008

(51) Int. Cl.

| | |
|---|---|
| ***A62C 35/02*** | (2006.01) |
| ***A62C 2/00*** | (2006.01) |
| ***A62C 29/00*** | (2006.01) |
| ***A62C 3/07*** | (2006.01) |
| ***A62C 3/08*** | (2006.01) |
| ***A62C 35/00*** | (2006.01) |
| ***B05B 1/24*** | (2006.01) |

(52) U.S. Cl. ..... 169/24; 169/43; 169/44; 169/52; 169/62; 239/129

(58) Field of Classification Search ..... 169/24, 169/43–44, 52, 62; 239/129
See application file for complete search history.

(56) References Cited

U.S. PATENT DOCUMENTS

| | | | | |
|---|---|---|---|---|
| 3,974,879 | A * | 8/1976 | Nelson et al. | 169/43 |
| 4,678,041 | A | 7/1987 | Staudinger | |
| 5,255,747 | A | 10/1993 | Teske et al. | |
| 5,427,081 | A | 6/1995 | Lasakaris et al. | |
| RE36,196 | E | 4/1999 | Eberhardt | |
| 6,009,953 | A * | 1/2000 | Laskaris et al. | 169/13 |
| 6,074,462 | A * | 6/2000 | Quinn et al. | 96/113 |
| 6,357,532 | B1 | 3/2002 | Laskaris et al. | |
| 6,571,882 | B2 * | 6/2003 | Yen | 169/24 |
| 6,675,437 | B1 * | 1/2004 | York | 15/321 |
| 6,682,313 | B1 * | 1/2004 | Sulmone | 417/199.2 |
| 6,858,066 | B2 * | 2/2005 | Quinn et al. | 95/121 |
| 6,991,041 | B2 | 1/2006 | Laskaris et al. | |
| 7,264,178 | B1 * | 9/2007 | Hugg | 239/129 |
| 7,363,127 | B2 * | 4/2008 | Fogelstrom | 701/29 |

* cited by examiner

*Primary Examiner*—Len Tran
*Assistant Examiner*—Justin Jonaitis
(74) *Attorney, Agent, or Firm*—Warner Norcross & Judd LLP

(57) ABSTRACT

A system for a firefighting vehicle including a single compressor, driven by the engine of the firefighting vehicle, which generates a compressed fluid supply for operation of both the compressed air foam system and air brakes of the firefighting vehicle. The system can include a fluid storage tank that receives compressed fluid generated by the compressor. The storage tank can be in fluid communication with a dryer and a foaming system. The dryer dries a portion of the compressed fluid and supplies the dry fluid to one or more brake system tanks, which further provide a fluid supply to one or more air brakes of the vehicle to provide a braking force to stop the vehicle. An optionally undried portion of the fluid in the fluid storage tank can be in communication with a conduit which is further in communication with a foam supply and a liquid supply which mix with the compressed fluid to create a compressed fluid foam firefighting material.

20 Claims, 3 Drawing Sheets

COMPRESSED FLUID SYSTEM AND RELATED METHOD

BACKGROUND OF THE INVENTION

The present invention relates to a compressed air foam system and methods of generating foam with such a system.

Compressed Air Foam Systems (CAFSs) are used in the firefighting industry to combine compressed air with water and foam to create a homogenized mixture of foam bubbles that are dense and tightly packed, and which quickly extinguish certain types of fires. CAFSs include two system components, one of which provides foam and water, and the other of which provides compressed air at about 50-100 cubic feet per minute (CFM) to improve the foaming characteristics of the water and foam.

A common CAFS is a self-contained, diesel-powered unit that is designed to fit in the bed of a pickup truck. This system includes a diesel engine, separate from the engine that powers the pickup, that operates a compressor to generate compressed air, as well as a pump that pumps water and foam to a line where it is combined with the compressed air. Although this system works well, it requires a completely separate pickup truck for transport.

Another system is an under hood CAFS, which adds a second compressor to a fire truck—in addition to a first compressor of the fire truck which is dedicated to the air brakes of the truck. The CAFS compressor pumps air to a holding tank. From the holding tank, the air is regulated through a line which is also plumbed into a water and foam line. The air, water and foam mix to create the compressed air foaming mixture. Although this unit works well, it adds yet another compressor to drain power from the engine of the fire truck, which already powers the separate air system including the air compressor for the air brakes of the truck.

Due to the construction of conventional CAFSs, there remains a long felt and unmet need for a CAFS that minimizes engine power rob, the duplication of components and the consumption of space on a firefighting vehicle.

SUMMARY OF THE INVENTION

The aforementioned problems are overcome by the present invention which provides a compressed fluid system including a single compressor, driven by the engine of a firefighting vehicle, which generates a compressed fluid supply for operation of both a compressed air foam system and air brakes of the firefighting vehicle. This can eliminate the need for an additional compressor to operate the vehicle's air brakes.

In one embodiment, the system can include a fluid storage tank in fluid communication with and receiving compressed fluid generated by the compressor. This fluid storage tank can be in fluid communication with a dryer and a foaming system. The dryer can dry a portion of the compressed fluid provided by the fluid storage tank.

In another embodiment, the dryer is in fluid communication with a brake system tank, to which the dryer supplies dry fluid. There can be multiple brake system tanks as desired, independently dedicated to front and/or rear brakes of the firefighting vehicle. The brake system tanks can be in further fluid communication with, and can provide a fluid supply to one or more air brakes of the vehicle to provide on demand braking force to stop the vehicle when desired.

In yet another embodiment, the system can include a foaming system conduit in fluid communication with the fluid storage tank, but not the dryer. The conduit can be in further fluid communication with a foam supply and a liquid supply.

In operation, the fluid storage tank can supply an undried (or "wet") portion of the compressed fluid to the conduit to mix with foam supplied by the foam supply and the water supplied by the water supply, and to create a compressed fluid foam firefighting material.

In a further embodiment, the system can include a governor that controls the compressor. For example, when the compressor generates over 120 psi in the storage tank, the governor senses this and puts the compressor in a neutral mode so that it discontinues pressurizing the storage tank. This can prevent over pressurization of the tank.

The present invention provides a single and efficient system that generates compressed fluid for operation of both a compressed air foam system and the air brakes of the firefighting vehicle. Where only a single compressor is used in the system to generate the fluid supply, energy generated by the vehicle engine is conserved. Moreover, where only a single compressor is used with the system, component cost for the vehicle is reduced due to the elimination of an extra compressor. Valuable equipment space on the vehicle is conserved as well.

These and other objects, advantages and features of the invention will be more readily understood and appreciated by reference to the detailed description of the invention and the drawings.

DETAILED DESCRIPTION OF THE CURRENT EMBODIMENT

I. Construction Overview

Figure 1:
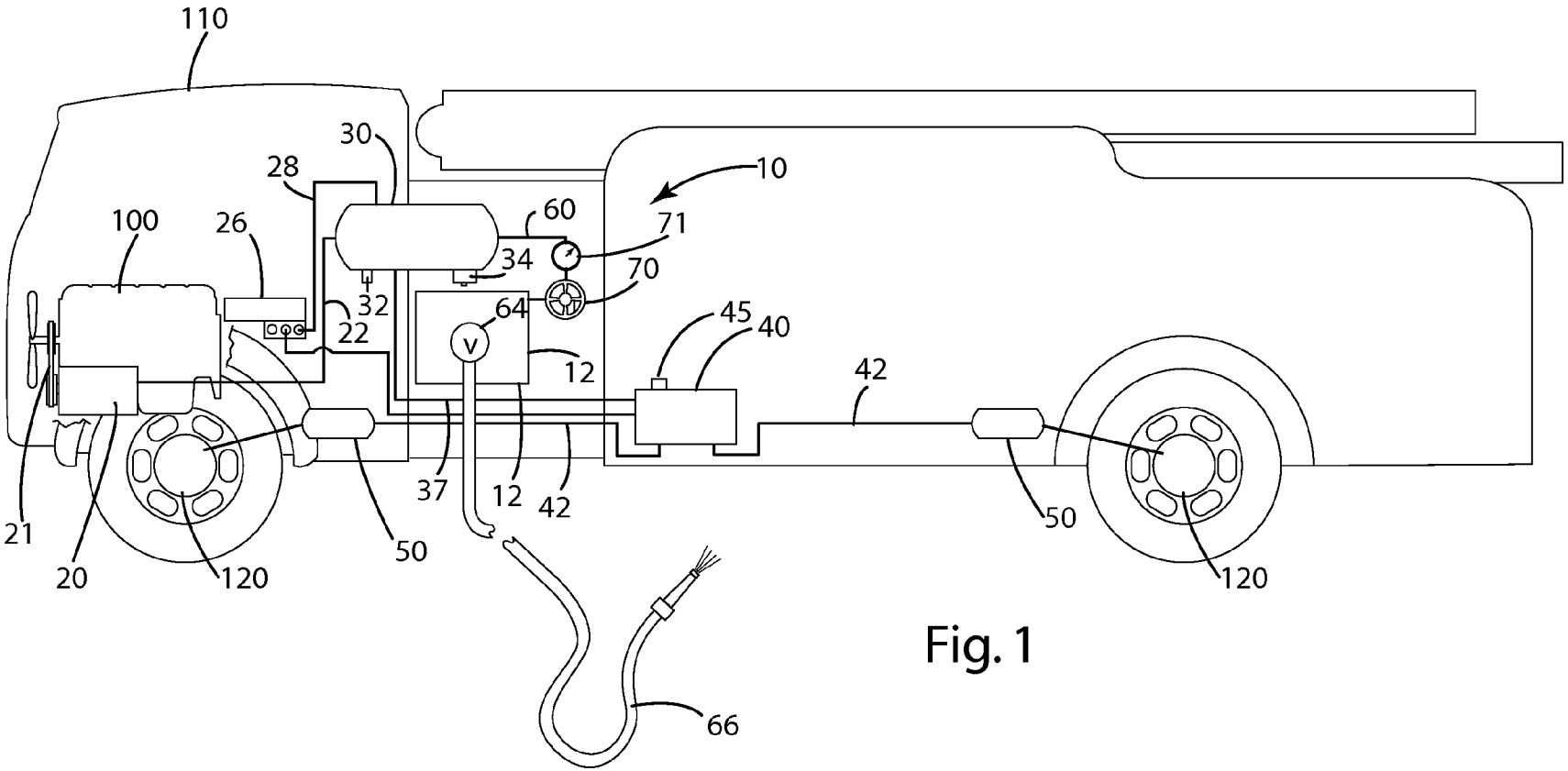
FIG. 1 is a side view of an embodiment of the system incorporated in a firefighting vehicle.
Figure 2:
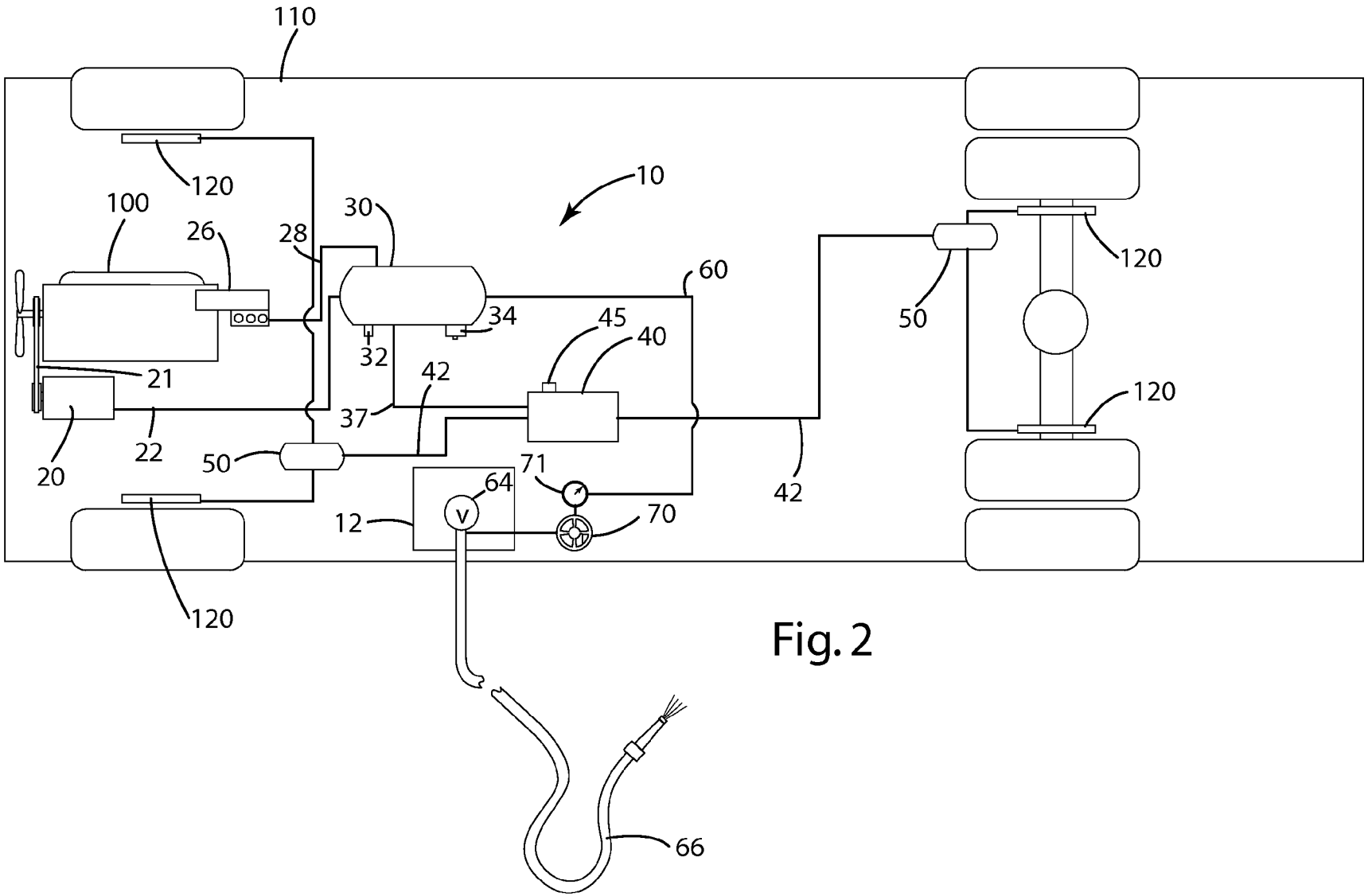
FIG. 2 is a top view of the system incorporated in the vehicle.
Figure 3:
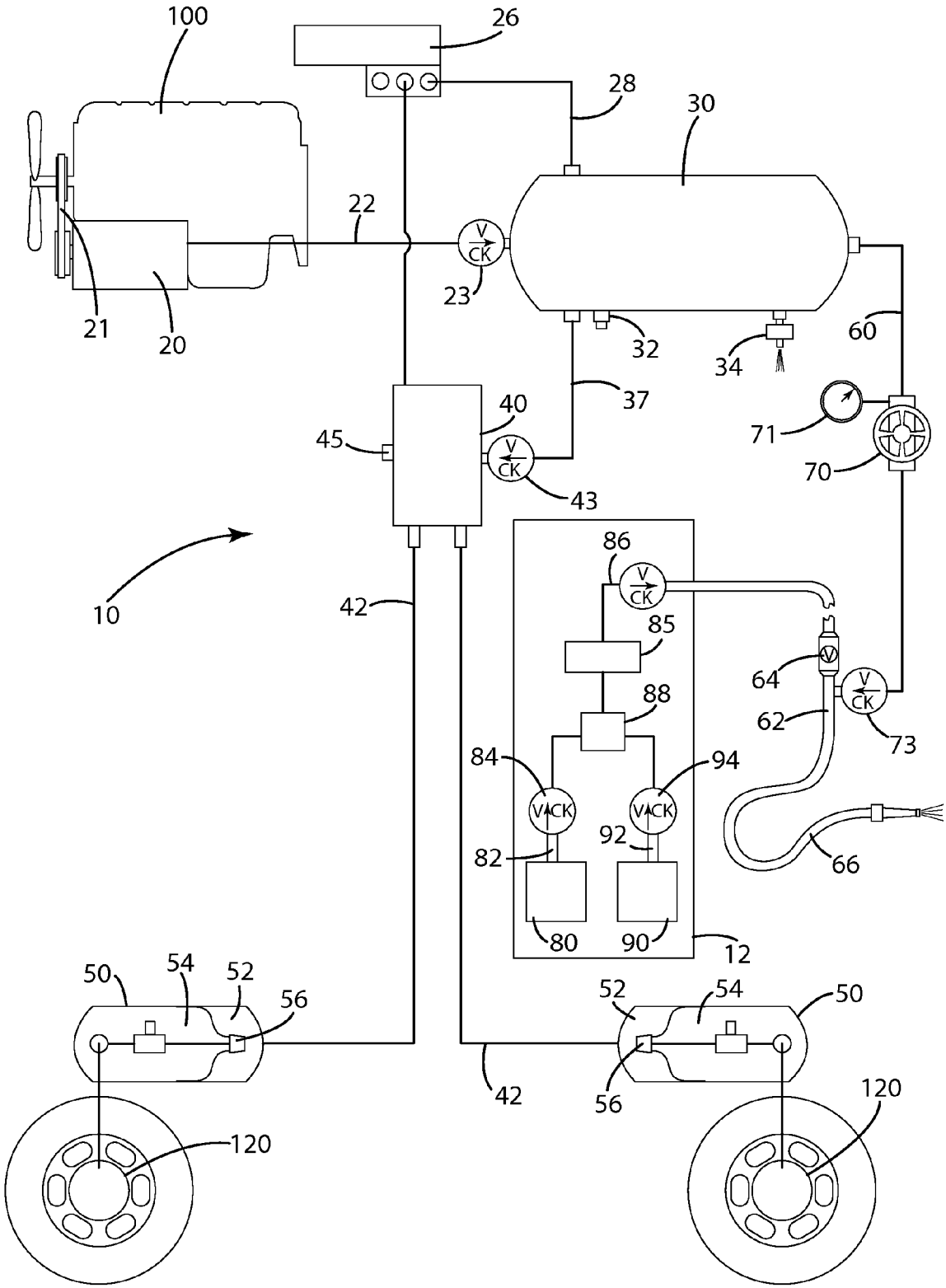
FIG. 3 is a schematic illustrating the plumbing of the system.

A system constructed in accordance with a current embodiment of the invention as illustrated in FIGS. 1-3 and generally designated 10. The system 10 generally includes a compressor 20 powered directly by the engine 100 of the firefighting vehicle 110. The compressor is in fluid communication with a storage tank 30, which is further in fluid communication with a dryer 40, which is in fluid communication with one or more brake system tanks 50 that supply compressed fluid to one or more brakes 120 on the truck 110. The tank 30 is also in fluid communication with a conduit 60 metered by a valve 70 to provide compressed air to combine with a liquid and foam provided by a water and foam supply system 12. For purposes of this disclosure, the system 10 is described in connection with its use with a fire truck; however, the system is well suited for use with any firefighting vehicle or device that includes a compressed air foam system and a brake system. In addition, although the system described herein compresses air, and uses water as the primary liquid in the compressed air foaming system, other fluids may be compressed by the compressor and other liquids may be utilized in the compressed air foaming system.

II. Components

With reference to the figures, the components of the system will now be described. The compressor 20 is mounted adjacent the engine 100 of the fire truck which propels the truck in normal use. The compressor 20 is driven by a belt, a chain or gears, any of which are generally referred to as a gear train 21, that are mounted to a drive system associated with the engine 100. The air compressor 20 can optionally be a rotary compressor, a reciprocating type of compressor, or any other compressor as desired. A suitable compressor 20 is a Wabco compressor, available from ArvinMeritor, Inc. of Troy, Mich.

The compressor optionally can be coupled to a turbo system for the engine, which provides increased airflow to the engine 100, to improve the air output by the compressor 20. For example, when using a Wabco twin cylinder 30 cubic feet per minute ("cfm") compressor in combination with air diverted from a turbo on the engine 100, which generates an additional 30 cfm, the total output by compressor can be about 60 cfm at idle. If the engine rpm is increased along with the turbo output, this output can be further increased.

Although not shown, the compressor 20 can be outfitted with an intake regulator which allows control of the air discharge pressure from the air compressor by throttling the air intake of the compressor. By decreasing the air flow into the air compressor, the air flow out of the air compressor can be reduced to allow the outlet air pressure to be controlled.

The compressor 20 is in fluid communication with a fluid storage tank 30, also referred to as a wet tank, via line 22. The tank 30 receives compressed air generated by the compressor 20 and stores it. The line 22 between the compressor and the storage tank 30 can include a check valve 23 to prevent air, once transferred to the wet tank, from returning to the compressor 20. The wet tank 30 can be outfitted with an optional pressure relief valve 32 to ensure that when a desired pressure is achieved in the tank (that pressure being generated by the compressor) the pressure relief valve will automatically dump excess pressurized air from the tank to achieve a desired, safe or pre-selected pressure. This feature can provide additional system protection if the governor, described below, fails to operate properly. The tank can also include a conventional moisture ejector 34 to drain condensate from the tank at pre-selected intervals or when the air stored in the tank reaches a pre-selected moisture level.

The system also can include a governor 26 in fluid communication with the wet tank 30 via line 28 and operably coupled to the compressor 20. The governor 26 can sense pressure within the tank 30. If the governor senses a pre-selected pressure, for example, pressure above 120 pounds per square inch (psi) in the tank 30, the governor will open ports (not shown) on the compressor 20 so that the compressor is put in a neutral mode in which it no longer continues to transfer compressed air to the wet tank 30. This prevents excess pressure build up in the tank 30 which may cause an unsafe condition. The exact pressure that triggers the governor to port the compressor can be adjusted to any pre-selected level depending on the pressure and volume capacity of the wet tank 30. Optionally, instead of being in fluid communication with the wet tank, the governor can include a sensor mounted in the tank that transmits a signal to the governor at pre-selected pressures to prompt the governor to actuate the compressor and put it in the neutral mode described above.

With reference to FIG. 3, the tank 30 is in fluid communication with a conduit 60 that is further in fluid communication with a water and foam supply system 12 including a water supply 80 and a foam supply 90. The conduit 60 can include a regulatory valve 70 that meters the compressed air fed for combination with the water and foam. This valve 70 can include a conventional air pressure gauge 71 for a user to monitor the air pressure in the conduit 60 and adjust the valve manually, which, in turn, meters the amount of pressurized air delivered to the water and foam mixture. Although not shown, the manual valve and visual gauge can be substituted with an electronic control system that meters the optimal compressed air flowing through the conduit for mixture with the water and foam supply.

As shown in FIG. 3, the conduit 60 can include a check valve 73 to prevent compressed air from returning back to the valve 70 and/or the wet tank 30 after it is ready to mix with the water and foam supplies. After the compressed air and water and foam supply mix, they create compressed air foam firefighting material which is forcefully expelled from hose 66.

FIG. 3 also shows the details of the water and foam supply system 12. Specifically, the water supply 80 is in fluid communication with a pump 88 via a line 82. Likewise, the foam supply 90 is in communication with that pump 88 via line 92. One or both lines 82 and 92 may include a check valve 84, 94 to prevent the other material from mixing with the respective supplies. The pump 88 pumps water from the water supply 80 and the foam from the foam supply 90 to a mixer 85 wherein the two components are mixed. In the water and foam chemical mixer 85, the foam chemical is added in the correct proportion to the water flow. Typically, Class A foams and Class B foams can be utilized. Where Class A foams are used, that chemical can be added at 0.3% to 0.5% by weight to the water. The finished fluid foam firefighting material can be routed from the outlet 62 to hose 66, which includes an appropriately sized nozzle. From the mixer, the mixed water and foam are pumped in a line 86 until they are brought in contact with the compressed air from the conduit and expelled through the valve 64 and from the outlet 62 as a compressed air foam firefighting material.

The compressed fluid system 10 also provides compressed fluid to the brake system of the fire engine truck. Specifically, a line 37 feeds compressed air from the wet tank 30 to a dryer 40. The line 37 may include a check valve 43 to prevent back flow to the wet tank, and to isolate the truck brake system downstream of the wet tank. The dryer can be a conventional one, designed to dry the air from the wet tank 30, which may be wet due to moisture in the air stored therein. Suitable dryers include Wabco System Saver™ air dryers available from ArvinMeritor, Inc. The dryer 40 can also be in communication with the compressor 26 to modulate the operation of the dryer when the fire engine 100 is being used to generate compressed air foam firefighting material. At that point there is no immediate need to divert air from the wet air tank, dry it and supply to the brake system because the vehicle typically is in neutral and there is no need for the application of a braking force. When the system 10 operates in this capacity, the system 10 is in a foaming mode wherein the engine drives the compressor which increases the pressure in the wet tank and that pressurized fluid in the wet tank 30 is diverted primarily to the conduit 60 and mirrored to combine with the water and foam supply to create the compressed air foam firefighting material.

The dryer 40 is in further fluid communication with one or more brake system tanks 50 via the supply lines 42. Each brake system tank 50 can be dedicated to the front or rear air brakes 120 of the truck 110. These air brakes 120 can be conventionally operated air brakes that provide sufficient braking force to the wheels associated with the brakes to stop the fire truck 110 at the braking force desired.

Each brake system tank 50 can be compartmentalized into a "wet" compartment 52 and a "dry" compartment 54 which are in fluid communication with one another via a pressure valve 56. In some circumstances, even though the dry air supplied by the dryer 40 to the brake tank 50 is supposed to be dry, upon introduction into the tank itself, the residual moisture in the air may condense on the sides of the first compartment 52. That moisture can condense and settle at the bottom of the first compartment 52. Air transferred from the first compartment 52 to the second compartment 54 usually is sufficiently dry given the location of the valve 56 above the moisture level. That air is transferred to the second compartment 54, and then supplied on demand to the brakes 120 of the truck 110.

All the components of the compressed fluid system 10 of the embodiment above can be modified or altered in dimension, capacity, output and the like as desired. For example, if the size of the wet tank or brake system tank require added capacity, the size of those tanks may be increased to provide such capacity.

II. Operation of the Compressed Fluid System

Operation of the compressed fluid system 10 will now be described in connection with FIGS. 1-3. In general, the system 10 provides compressed air generated by a single compressor to both a compressed air system and an air brake system of the firefighting vehicle 110. The engine 100 of the fire truck 110 can operate to propel the fire truck 110 in a drive mode. In addition, the engine can transfer force to the compressor 20 to generate compressed fluid to operate the air brakes and/or operate the compressed air foaming system.

In an exemplary foaming mode, the engine runs the compressor 20 to intake fluid (e.g., air), compress it and output the air through the line 22 to the wet tank 30. That compressed air is stored in the wet tank 30 until the valve 70 is opened to transfer that pressurized air through the conduit 60 and mix the pressurized air with the water and foam supply provided from the water and foam mixer 85 to create a compressed air foam firefighting material.

As noted above, the governor 26 also ensures that the pressure in the wet tank 30 does not exceed a pre-selected pressure, for example, 120 psi. It does this with a spring valve (not shown) in fluid communication with the tank 30 via the line 28. When pressure from the tank 30 exerts a pressure on the spring valve greater than a pre-selected pressure, for example, 120 psi, the governor will open exhaust ports (not shown) on the compressor so that the compressor no longer continues to pressurize the tank 30 with the generated compressed air. In addition, the pressure relief valve 32 operates at a pre-selected level as backup to the governor safety. For example, when the pressure in the tank exceeds a pre-determined pressure, for example, 150 psi, it automatically exhausts excess pressure from the tank 30.

The brake system of the truck 110 is isolated downstream of the wet air tank 30 primarily by the dryer 40 and check valve 43. In operation, the system 10 conducts wet pressurized fluid from the wet tank 30 to the dryer 40 via the line 37. Because the compressed fluid stored in the tank 30 is wet, it is not suitable for use in the brake system because excessive moisture in the wet fluid will potentially deteriorate components of the brake system and deteriorate the function of those components. Therefore, the dryer 40 dries the air and transfers that dry air via the lines 42 to the front and/or rear brake system tanks 50. These tanks 50 supply pressurized air to the brakes of the truck on demand, via conventional air brake controls, to provide the braking force necessary to stop the truck.

As noted above, sometimes the dry air supplied by the dryer 40 to the tank 50 will condense inside the first compartment 52 of the tank 50. To rid the compartment 52 of this moisture, the system 10 can be equipped with a purge system. Specifically, the air dryer is in communication with the governor. When the governor turns off the compressor, the dryer recognizes this condition and opens a dump valve 45 that is in communication with the lines 42. Due to the pressure in the tank compartment 52, the wet air is expelled through the dump valve 45. The dryer is also equipped to sense when the dumping ceases. When this condition is sensed, the dump valve 45 is closed. Simultaneously, the low pressure sensed in the line 42 that is in fluid communication with the tank 52 resets the dryer 40 so that it is enabled to receive air from the wet tank. Accordingly, the compressed fluid in the wet tank 30, due to a pressure differential between the wet tank and the dryer 40, expels air through the line 37 to the dryer, which begins its drying cycle and replenishes the compressed air supply in the compartment 52 until it has reached a level adequate to operate the brake system. In addition, because they compartment 54 is separated from the compartment 52, the pressure in the compartment 54 is not significantly diminished so that the brake system can continue to operate normally during the purge cycle described above.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. A compressed fluid system for a firefighting vehicle including an engine comprising:

a single compressor which is driven by the engine of the firefighting vehicle, and which generates a compressed fluid;

a fluid storage tank in fluid communication with and receiving the compressed fluid;

a dryer in fluid communication with the fluid storage tank, the fluid storage tank supplying a first portion of the compressed fluid to the dryer, the dryer adapted to dry the first portion of compressed fluid to provide dry fluid;

a dryer in fluid communication with the fluid storage tank, the fluid storage tank supplying a first portion of the compressed fluid to the dryer adapted to dry the first portion of compressed fluid to provide dry fluid;

a brake system tank in fluid communication with the dryer, the dryer supplying the dry fluid to the brake system tank;

a brake in fluid communication with the brake system tank, the brake system tank selectively supplying the dry fluid to the brake to actuate the brake and provide a braking force for a firefighting vehicle;

a conduit in fluid communication with the fluid storage tank, but not the dryer, the conduit in further fluid communication with at least one of a foam supply and a liquid supply, the fluid storage tank supplying a second portion of the compressed fluid to the conduit to mix with at least one of foam supplied by the foam supply and water supplied by the liquid supply and to create a compressed fluid foam firefighting material, the second portion of the compressed fluid continuing to flow through the conduit for mixture with the at least one of foam and water to provide the firefighting material as the water continues to be supplied by the liquid supply.

2. The compressed fluid system of claim 1 comprising a governor, the governor including a sensor to monitor the pressure in the fluid storage tank.

3. The compressed fluid system of claim 2 wherein the governor releases pressure from the fluid storage tank when pressure in the fluid storage tank reaches a predetermined value.

4. The compressed fluid system of claim 1 comprising a gear train coupled to the engine, the gear train engaging the compressor to generate the compressed fluid.

5. The compressed fluid system of claim 1 comprising a moisture ejector in communication with the fluid storage tank to selectively release moisture from the fluid storage tank.

6. The compressed fluid system of claim 1 wherein the second portion of the compressed fluid mixes with the foam and water.

7. A compressed air system for a firefighting vehicle including an engine comprising:

a brake system including at least one brake adapted to provide a braking force for the firefighting vehicle when the brake is actuated;

a single compressor which is driven by the engine of the firefighting vehicle, and which generates compressed air;

a storage tank in fluid communication with and receiving the compressed air;

a dryer in fluid communication with the storage tank, the storage tank supplying a first portion of the compressed air to the dryer, the dryer adapted to dry the first portion of compressed air to provide dry air;

a brake system tank in fluid communication with the dryer, the dryer supplying the dry air to the brake system tank, the brake system tank in fluid communication with the brake system and selectively supplying the dry air to the brake to actuate the brake and provide the braking force for the firefighting vehicle;

a liquid supply;

a foam supply;

a conduit in fluid communication with the storage tank, the conduit in further fluid communication with a mixer for mixing foam supplied by the foam supply with water supplied by the liquid supply to create a fluid foam;

wherein the storage tank supplies a second portion of the compressed air to the conduit to mix with the fluid foam to create a compressed air foam firefighting material.

8. The compressed air system of claim 7 comprising a governor in fluid communication with the dryer, the governor releasing pressure from the dryer tank when pressure in the dryer reaches a predetermined value.

9. The compressed air system of claim 7 comprising another brake system tank in fluid communication with the dryer, the dryer supplying the dry air to the another brake system tank, the another brake system tank in fluid communication with another brake and selectively supplying the dry air to the another brake system to actuate the another brake and provide braking force for the firefighting vehicle.

10. The compressed air system of claim 7 comprising a pressure relief valve joined with the brake system tank to relieve excess pressure from the brake system tank when the pressure exceeds a predetermined level.

11. The compressed air system of claim 7 wherein the engine of the firefighting vehicle provides force to move the firefighting vehicle.

12. The compressed air system of claim 7 wherein the brake system tank stores the dry air until the dry air is required to provide braking force.

13. The compressed air system of claim 7 comprising a manually adjustable valve adapted to meter the second portion of the compressed air that mixes with the at least one of foam supplied by the foam supply and the water supplied by the water supply.

14. A method for generating compressed fluid for at least one of braking and foaming comprising:

providing an engine of a firefighting vehicle that operates in at least one of a drive mode, in which the engine propels the engine, and a foaming mode, in which the engine directly drives a single compressor;

generating a compressed fluid with the compressor in at least one of the foaming mode and the drive mode;

storing the compressed fluid in a fluid storage tank;

drying a first portion of compressed fluid to produce a dry fluid;

supplying the dry fluid to a brake to provide a braking force for the firefighting vehicle when the vehicle is in the drive mode; and supplying a second portion of the compressed fluid to a conduit to mix with at least one of foam and water to create a compressed fluid foam firefighting material when the vehicle is in the foaming mode, the second portion of compressed fluid flowing through the conduit as the at least one of water and foam continues to flow through the conduit.

15. The method of claim 14 comprising supplying the dry fluid to a brake system tank, and then selectively supplying the dry fluid from the brake system tank to the brake to provide the braking force.

16. The method of claim 14 comprising measuring pressure in the fluid storage tank.

17. The method of claim 16 comprising relieving fluid from the fluid storage tank when the measured pressure exceeds a pre-selected pressure.

18. The method of claim 14 comprising governing the amount of compressed fluid in the fluid storage tank.

19. The method of claim 14 comprising storing a portion of the dry fluid in a first brake system storage tank connected to a front brake of the vehicle and another portion of the dry fluid in a second brake system storage tank connected to a rear brake of the vehicle.

20. The compressed fluid system of claim 1 further comprising a mixer in fluid communication with the conduit, foam supply and liquid supply, the mixer adapted to mix foam supplied by the foam supply with water supplied by the water supply to create a fluid foam.

* * * * *

UNITED STATES PATENT AND TRADEMARK OFFICE

CERTIFICATE OF CORRECTION

PATENT NO. : 7,530,404 B2
APPLICATION NO. : 11/458796
DATED : May 12, 2009
INVENTOR(S) : Lenz, Jr.

It is certified that error appears in the above-identified patent and that said Letters Patent is hereby corrected as shown below:

Column 6, Claim 1, Lines 32-44:

"a fluid storage tank in fluid communication with and receiving the compressed fluid;

a dryer in fluid communication with the fluid storage tank, the fluid storage tank supplying a first portion of the compressed fluid to the dryer, the dryer adapted to dry the first portion of compressed fluid to provide dry fluid;

a dryer in fluid communication with the fluid storage tank, the fluid storage tank supplying a first portion of the compressed fluid to the dryer adapted to dry the first portion of compressed fluid to provide dry fluid;

a brake system tank in fluid communication with the dryer, the dryer supplying the dry fluid to the brake system tank;"

should be:

--a fluid storage tank in fluid communication with and receiving the compressed fluid;

a dryer in fluid communication with the fluid storage tank, the fluid storage tank supplying a first portion of the compressed fluid to the dryer, the dryer adapted to dry the first portion of compressed fluid to provide dry fluid;

a brake system tank in fluid communication with the dryer, the dryer supplying the dry fluid to the brake system tank;--

Signed and Sealed this

Third Day of November, 2009

David J. Kappos

David J. Kappos
*Director of the United States Patent and Trademark Office*